US009799991B2

(12) United States Patent
Yi

(10) Patent No.: US 9,799,991 B2
(45) Date of Patent: Oct. 24, 2017

(54) POWER CORD RETAINER

(71) Applicant: SanDisk Technologies LLC, Plano, TX (US)

(72) Inventor: George Yi, Fremont, CA (US)

(73) Assignee: SANDISK TECHNOLOGIES LLC, Plano, TX (US)

( * ) Notice: Subject to any disclaimer, the term of this patent is extended or adjusted under 35 U.S.C. 154(b) by 0 days.

(21) Appl. No.: 15/195,922

(22) Filed: Jun. 28, 2016

(65) Prior Publication Data

US 2017/0077648 A1 Mar. 16, 2017

Related U.S. Application Data

(60) Provisional application No. 62/218,381, filed on Sep. 14, 2015.

(51) Int. Cl.

| | |
|---|---|
| ***H01R 13/639*** | (2006.01) |
| *H01R 103/00* | (2006.01) |
| *H01R 24/78* | (2011.01) |

(52) U.S. Cl.

CPC ..... *H01R 13/6392* (2013.01); *H01R 24/78* (2013.01); *H01R 2103/00* (2013.01)

(58) Field of Classification Search

CPC . H01R 13/6392; H01R 24/78; H01R 2103/00
USPC ..... 439/345, 346, 369, 367, 373, 357, 519
See application file for complete search history.

(56) References Cited

U.S. PATENT DOCUMENTS

| | | | | |
|---|---|---|---|---|
| 3,710,199 | A | 1/1973 | Cignoni, Jr. | |
| 4,614,383 | A | 9/1986 | Polley et al. | |
| 5,196,987 | A | 3/1993 | Webber et al. | |
| 5,245,527 | A | 9/1993 | Duff et al. | |
| 6,067,233 | A | 5/2000 | English et al. | |
| 6,070,742 | A | 6/2000 | McAnally et al. | |
| 6,071,142 | A * | 6/2000 | Blackman | H01R 13/6395 439/373 |
| 6,160,699 | A | 12/2000 | Gibson et al. | |
| 6,259,604 | B1 | 7/2001 | Küster | |

(Continued)

OTHER PUBLICATIONS

Facebook, "Open Rack Specification V2," Revision 4, Apr. 11, 2014, 9 pages.

(Continued)

*Primary Examiner* — Alexander Gilman

(74) *Attorney, Agent, or Firm* — Morgan, Lewis & Bockius LLP

(57) ABSTRACT

A power cord retainer is provided for an equipment module including a chassis, a power receptacle, a handle adjacent to the receptacle, and a power cord. The power cord retainer includes a cable clip with a clip portion configured to engage a cable of the power cord, and a mounting portion extending from the clip portion. The power cord retainer also includes a bracket with an elongated section, a plurality of mounts extending along a length of the elongated section for adjustably receiving the mounting portion of the cable clip, and a hook section at one end of the elongated portion configured for partially encircling the equipment module handle. The power cord retainer is configured to secure the power cord plug in the equipment module power receptacle when the clip portion engages the power cord cable and the hook section partially encircles the equipment module handle.

20 Claims, 4 Drawing Sheets

(56) References Cited

U.S. PATENT DOCUMENTS 6,303,864 B1 10/2001 Johnson et al.
6,305,556 B1 10/2001 Mayer
6,326,547 B1 12/2001 Saxby et al.
6,327,139 B1 12/2001 Champion et al.
6,435,354 B1 8/2002 Gray et al.
6,501,020 B2 12/2002 Grant et al.
6,523,918 B1 2/2003 Baiza
6,544,057 B1 4/2003 Stremick et al.
6,600,665 B2 7/2003 Lauchner
6,683,252 B2 1/2004 Sobel et al.
6,747,874 B2 6/2004 McKinnon et al.
6,767,237 B1 * 7/2004 Shih ..... H01R 13/6392 439/371
6,805,248 B2 10/2004 Champion et al.
6,854,605 B2 2/2005 Wrycraft
6,902,069 B2 6/2005 Hartman et al.
6,945,504 B2 9/2005 Chen et al.
6,972,949 B1 12/2005 Helgenberg et al.
7,009,112 B1 3/2006 Mead et al.
7,023,708 B2 4/2006 Nguyen et al.
7,026,551 B2 4/2006 Franz et al.
7,121,412 B2 10/2006 Richards et al.
7,168,576 B2 1/2007 Williams
7,189,924 B1 3/2007 Popescu et al.
7,195,511 B1 * 3/2007 Ornt ..... H01R 13/5833 439/369
7,201,279 B1 4/2007 Mimlitch, III
7,258,583 B1 8/2007 Baiza
7,429,701 B1 * 9/2008 Kushnir ..... H01R 13/6392 174/154
7,472,795 B2 1/2009 Dubon et al.
7,473,846 B2 1/2009 Doerr et al.
7,554,819 B2 6/2009 Chen et al.
7,568,935 B1 * 8/2009 Gonzalez ..... H01R 13/6395 439/345
7,654,398 B2 2/2010 Bridges et al.
7,695,305 B1 * 4/2010 Ray ..... H01R 13/6395 439/359
7,850,478 B2 * 12/2010 Lin ..... H01R 13/6395 439/372
7,901,241 B1 3/2011 Larkin
8,045,343 B2 10/2011 Fan et al.
8,134,074 B2 * 3/2012 Ong ..... H05K 7/1421 174/135
8,167,146 B2 5/2012 Yu et al.
8,186,634 B2 5/2012 Chen et al.
8,231,014 B2 7/2012 Chen et al.
8,337,236 B2 * 12/2012 Shu ..... H01R 13/6395 439/369
8,456,845 B2 * 6/2013 Liu ..... G06F 1/188 361/695
8,472,198 B2 6/2013 Peng et al.
8,477,491 B1 7/2013 Ross et al.
8,729,389 B2 5/2014 Hallet et al.
8,986,040 B2 * 3/2015 Garofalo ..... H01R 13/6395 439/373
9,144,174 B2 9/2015 Chen et al.
9,173,312 B1 10/2015 Jau et al.
9,210,828 B2 * 12/2015 Liao ..... H05K 7/1492
9,391,402 B2 * 7/2016 Lin ..... H01R 9/18
2001/0026436 A1 10/2001 Tanzer et al.
2003/0209361 A1 * 11/2003 Sivertsen ..... H01R 13/6395 174/135
2004/0120134 A1 6/2004 Nguyen et al.
2006/0011380 A1 * 1/2006 Pierce ..... H02G 3/32 174/135
2006/0046557 A1 * 3/2006 Pulizzi ..... H01R 13/5804 439/371
2006/0113433 A1 6/2006 Chen et al.
2007/0291430 A1 12/2007 Spitaels et al.
2008/0093958 A1 4/2008 Peterson
2008/0264880 A1 10/2008 Wagner et al.
2009/0078834 A1 3/2009 Chen et al.
2011/0100933 A1 5/2011 Kitten
2012/0162883 A1 6/2012 Jai
2012/0190225 A1 7/2012 Bessyo et al.
2012/0293932 A1 11/2012 Jai
2013/0039003 A1 2/2013 Li et al.
2013/0058028 A1 3/2013 Lu et al.
2013/0135792 A1 5/2013 Deshayes
2013/0341471 A1 12/2013 Yang et al.
2014/0183306 A1 7/2014 Chen et al.
2014/0376870 A1 12/2014 Takeuchi et al.
2015/0036272 A1 2/2015 Tachibana et al.
2015/0098168 A1 4/2015 Liang
2015/0103488 A1 4/2015 Tanaka
2016/0037667 A1 2/2016 Wu

OTHER PUBLICATIONS

International Search Report and Written Opinion dated Jul. 26, 2016, received in International Patent Application No. PCT/US2016/027924, which corresponds to U.S. Appl. No. 14/688,954, 12 pages (Yi).

* cited by examiner

POWER CORD RETAINER

RELATED APPLICATIONS

This application claims priority to U.S. provisional patent application No. 62/218,381, filed Sep. 14, 2015, which is hereby incorporated by reference in its entirety.

TECHNICAL FIELD

The disclosed embodiments relate generally to power cord retainers.

BACKGROUND

It is well known to use equipment racks for mounting and supporting multiple equipment modules. For example, 19-inch racks are widely used in modern data centers, ISP facilities and corporate server rooms for mounting and supporting various equipment modules, including computing, data storage, network, telecommunication, audio, and/or video equipment. Such equipment modules generally have power supply units (PSUs) to power the modules and/or the system. Such PSUs generally have a conventional power cord that plugs into a receptacle on the back side of the PSU. Unfortunately, such power cords may be inadvertently unplugged from the PSU causing an unexpected power off that could be serious for the modules and/or the system, including irreparable or irretrievable data loss.

For example, such power cords may be inadvertently unplugged as an equipment module is pulled out from an equipment rack for service simply because the power cord is too short, and/or because the power cord is caught by another object, such as an adjacent module or cable management arm. Also, such power cords may be inadvertently unplugged while service personal works on the equipment module while it is mounted in an equipment rack or is simply resting on a desk or workbench, and the service personal accidently pulls the power cord from the module and disconnects the power to the module. Similarly, a user may simply inadvertently pull the power cord from the module while handling the module and/or power cord thus disconnecting power to the module.

Some existing retainers include wire retainers that are configured to hold a power cord plug at one end and clip to holes on a chassis at the other end. An example of such a conventional wire retainer is described in U.S. Pat. No. 8,777,655 to Blanton. Since the wire retainer is fixed in length, it works well for a specific overmold configuration of a power cord plug. It also requires that a chassis be provided with specifically configured holes in the chassis to properly position and hold the wire retainer.

Other existing retainers include molded plastic retainers that engage with a handle of a chassis. An example of such a conventional plastic retainer is described in U.S. Pat. No. 8,847,085 to Chen. Similar to the wire retainer described above, such plastic retainers are generally configured to work for a specific overmold configuration of a power cord plug and a specific chassis configuration.

In light of the foregoing, it would be beneficial to have a power cord retainer that overcomes the above and other disadvantages of currently available cord retainers such as wire retainers and plastic retainers.

SUMMARY

Various embodiments of systems, apparatuses and devices within the scope of the appended claims each have several aspects, no single one of which is solely responsible for the attributes described herein. Without limiting the scope of the appended claims, after considering this disclosure, and particularly after considering the section entitled "Detailed Description" one will understand the aspects of various embodiments of the disclosed power cord retainer.

One aspect is directed to a power cord retainer for securing a power cord plug with an equipment module receptacle. The power cord retainer generally includes a cable clip configured to engage a power cord and a bracket configured to engage an equipment module handle.

Another aspect is directed to a power cord retainer apparatus for securing a power cord plug with an equipment module receptacle. The power cord retainer apparatus generally includes an equipment module, a power cord, and a power cord retainer having a cable clip engaging the power cord and a bracket engaging a handle of the equipment module.

BRIEF DESCRIPTION OF THE DRAWINGS

So that the present disclosure can be understood in greater detail, a more particular description may be had by reference to the features of various embodiments, some of which are illustrated in the appended drawings. The appended drawings, however, merely illustrate pertinent features of the present disclosure and are therefore not to be considered limiting, for the description may admit to other effective features.

Figure 1:
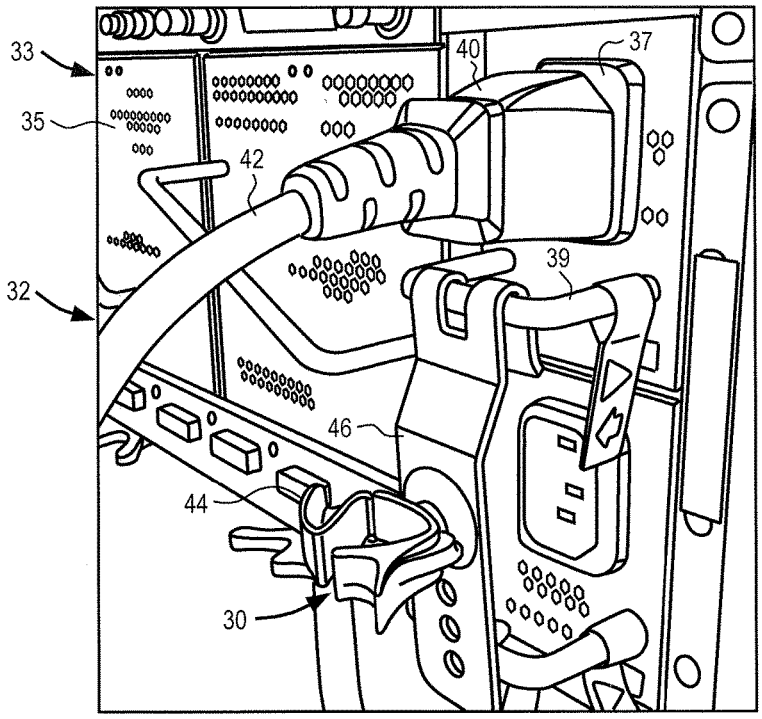
FIG. 1 is a perspective view of an exemplary power cord retainer in accordance with various aspects of the present invention, the power cord retainer shown mounted in a first position on a rack-mountable equipment module.

In accordance with common practice the various features illustrated in the drawings may not be drawn to scale. Accordingly, the dimensions of the various features may be arbitrarily expanded or reduced for clarity. In addition, some of the drawings may not depict all of the components of a given system, apparatus or device. Finally, like reference numerals may be used to denote like features throughout the specification and figures.

DETAILED DESCRIPTION

The various embodiments described herein include systems, apparatuses and/or devices for securing a power cord to an equipment module to prevent inadvertent unplugging and undesirable power loss. In particular, the various embodiments described herein include a power cord retainer for securing a power cord plug with an equipment module receptacle.

(A1) More specifically, some embodiments include a power cord retainer for an equipment module, the equipment module including a chassis, a power receptacle mounted on the chassis, a handle extending from the chassis adjacent the receptacle, and a power cord having a plug removably received by the power receptacle and a cable extending from the plug, the power cord retainer including: a cable clip including a clip portion configured to engage the cable beyond the plug, the cable clip further including a mounting portion extending from the clip portion; and a bracket including an elongated section, a plurality of mounts extending along a length of the elongated section for adjustably receiving the mounting portion of the cable clip, and a hook section at one end of the elongated portion configured for partially encircling the equipment module handle; wherein the power cord retainer is configured to secure the power cord plug in the equipment module power receptacle when the clip portion engages the power cord cable and the hook section partially encircles the equipment module handle.

(A2) In some embodiments, of the power cord retainer of A1, the clip portion is a plastic.

(A3) In some embodiments of the power cord retainer of A1 or A2, the clip portion includes a releasable latch and a clamp arm configured for encircling the cable and releasably engaging the latch.

(A4) In some embodiments of the power cord retainer of A3, the clamp arm includes a plurality of ratchet teeth for adjustably engaging the releasable latch.

(A5) In some embodiments of the power cord retainer of A1 to A4, the bracket is formed of sheet metal.

(A6) In some embodiments of the power cord retainer of A1 to A5, the plurality of mounts is a plurality of apertures extending along the length of the elongated section of the bracket.

(A7) In some embodiments of the power cord retainer of A1 to A6, the hook section includes a U-shaped flange dimensioned to receive a portion of the equipment module handle.

(A8) In some embodiments of the power cord retainer of A1 to A7, the hook section includes a reduced cross-sectional area portion that is configured to contact the equipment handle, whereby the reduced cross-sectional area portion is configured to reduce conductive heat transfer from the equipment module handle to the bracket.

(A9) In some embodiments of the power cord retainer of A1 to A8, the hook section includes a cut configured to reduce the cross-sectional area of the bracket contacting the equipment handle to reduce conductive heat transfer from the equipment module handle to the bracket.

(A10) In some embodiments of the power cord retainer of A1 to A9, the bracket includes an inclined section interconnecting the elongated section and the hook section offsetting the elongated section from the hook section.

(A11) In some embodiments of the power cord retainer of A1 to A10, the bracket includes an anti-rotation arm extending beyond the hook section configured to abut against an underside of the handle and prevent downward rotation of the bracket relative to the handle.

(B1) Some embodiments include a power cord retainer apparatus including: an equipment module, the equipment module including a chassis, a power receptacle mounted on the chassis, and a handle extending from the chassis adjacent the receptacle; a power cord having a plug removably received by the power receptacle and a cable extending from the plug; and a power cord retainer including: a cable clip including a clip portion releasably engaging the cable beyond the plug, the cable clip further including a mounting portion extending from the clip portion; and a bracket including an elongated section, a plurality of mounts extending along a length of the elongated section for adjustably receiving the mounting portion of the cable clip, and a hook section at one end of the elongated portion partially encircling the equipment module handle; wherein the power cord retainer secures the power cord plug in the equipment module power receptacle when the clip portion engages the power cord cable and the hook section partially encircles the equipment module handle.

(B2) In some embodiments of the power cord retainer of B1, the clip portion is a plastic.

(B3) In some embodiments of the power cord retainer of B1 or B2, wherein the clip portion includes a releasable latch and a clamp arm configured for encircling the cable and adjustably engaging the latch.

(B4) In some embodiments of the power cord retainer of B3, the clamp arm includes a plurality of ratchet teeth for adjustably engaging the releasable latch.

(B5) In some embodiments of the power cord retainer of B1 to B4, the bracket is formed of sheet metal.

(B6) In some embodiments of the power cord retainer of B1 to B5, the plurality of mounts is a plurality of apertures extending along the length of the elongated section of the bracket.

(B7) In some embodiments of the power cord retainer of B1 to B6, the hook section includes a U-shaped flange dimensioned to receive a portion of the equipment module handle.

(B8) In some embodiments of the power cord retainer of B1 to B7, the hook section includes a reduced cross-sectional area portion that is configured to contact the equipment handle, whereby the reduced cross-sectional area portion is configured to reduce conductive heat transfer from the equipment module handle to the bracket.

(B9) In some embodiments of the power cord retainer of B1 to B8, the hook section includes a cut configured to reduce the cross-sectional area of the bracket contacting the equipment handle to reduce conductive heat transfer from the equipment module handle to the bracket.

(B10) In some embodiments of the power cord retainer of B1 to B9, the bracket includes an inclined section interconnecting the elongated section and the hook section offsetting the elongated section from the hook section.

(B11) In some embodiments of the power cord retainer of B1 to B10, the bracket includes an anti-rotation arm extending beyond the hook section configured to abut against an underside of the handle and prevent downward rotation of the bracket relative to the handle.

Numerous details are described herein in order to provide a thorough understanding of the exemplary embodiments illustrated in the accompanying drawings. However, some embodiments may be practiced without many of the specific details, and the scope of the claims is only limited by those features and aspects specifically recited in the claims, including various alternatives, modifications, equivalents and other embodiments, which may be included within the spirit and scope of the claims. Furthermore, well-known components have not been described in exhaustive detail so as not to unnecessarily obscure pertinent aspects of the embodiments described herein.

Figure 2:
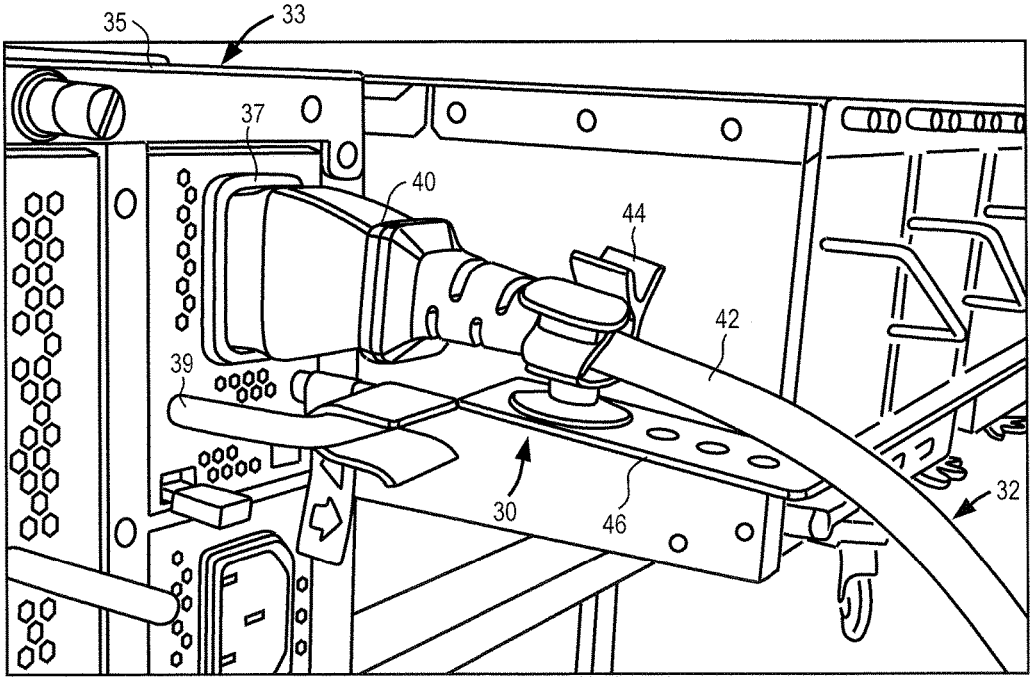
FIG. 2 is a perspective view of the power cord retainer of FIG. 1, with the power cord retainer shown mounted in a second position on the equipment module.
Figure 3:
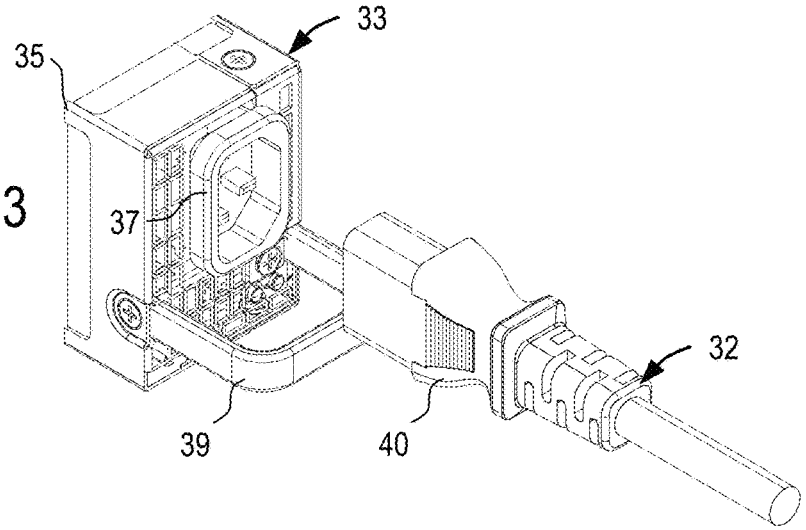
FIG. 3 is a perspective view of an exemplary rack-mountable equipment module shown with a power cord being inserted in to a receptacle of the equipment module.
Figure 4:
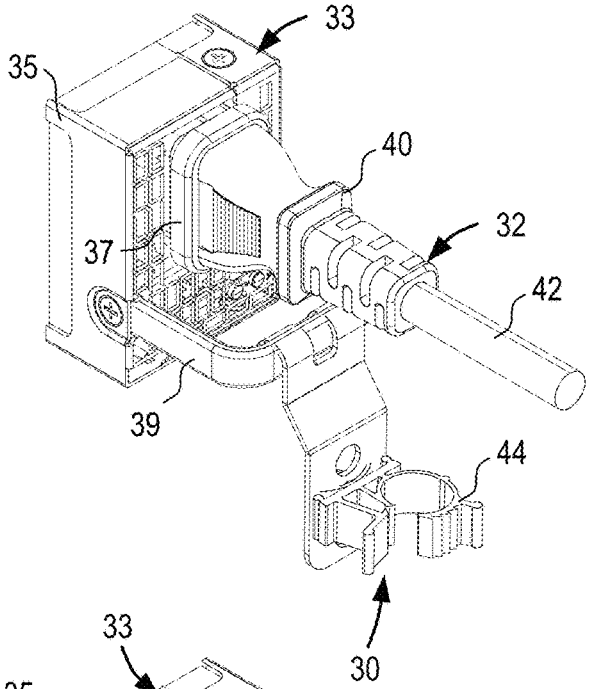
FIG. 4 is another exemplary power cord retainer in accordance with various aspects of the present invention, the power cord retainer shown mounted in a first position on the equipment module of FIG. 3.
Figure 5:
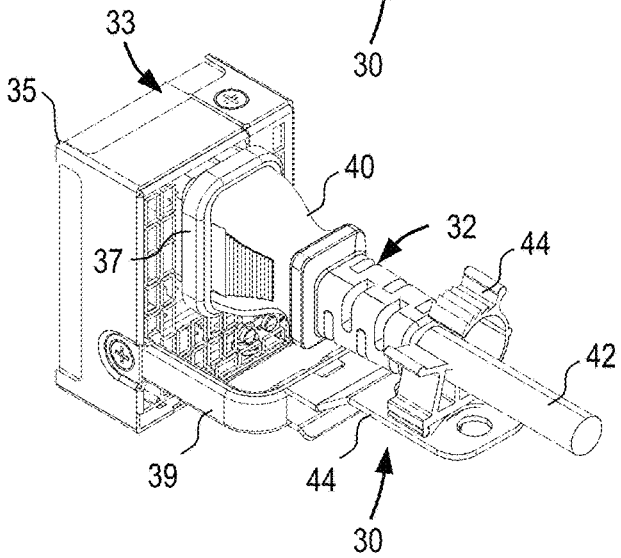
FIG. 5 is a perspective view of the power cord retainer of FIG. 4, with the power cord retainer shown mounted in a second position on the equipment module.

Turning now to the drawings, FIGS. 1 and 2 illustrate an exemplary power cord retainer 30 that, in accordance with various aspects of the present invention, is configured to prevent a power cord 32 from being inadvertantly unpluged from an equipment module 33.

The power cord retainer of the present invention is particularly well suited for use with equipment modules such as power supply units (PSUs) and other components that are dimensioned and configured to be housed within an equipment rack, including but not limited to 19-inch racks, 23-inch racks, Open Compute Project (OCP) racks, and etc. Such equipment modules may be mounted on a slide assembly in order to allow a user to slide the equipment module into and out of the equipment rack for ready access and/or installation. In such cases, the power cord retainer 30 may be used to avoid the power cord from being inadvertently unplugged from the equipment module as it slides forward from the equipment rack. Similarly, power cord retainer 30 may be used to avoid service personal and other users from inadvertently pulling the power cord from the equipment module and thus prevent disconnecting power to the module.

The power cord retainer 30 is particularly well suited for use with an equipment module 33 including a chassis 35, a power receptacle 37 mounted on the chassis, a handle 39 extending from the chassis adjacent the receptacle in combination with a power cord 32 including a plug 40 removably received by the power receptacle 37 and a cable 42 extending from the plug.

The power cord retainer generally includes a cable clip 44 adjustably mounted on a bracket 46. The cable clip is dimensioned and configured to releasably engage the cable 42 of the power cord 32, while the bracket is dimensioned and configured to releasably engage the handle 39 of the equipment module 33.

Figure 6:
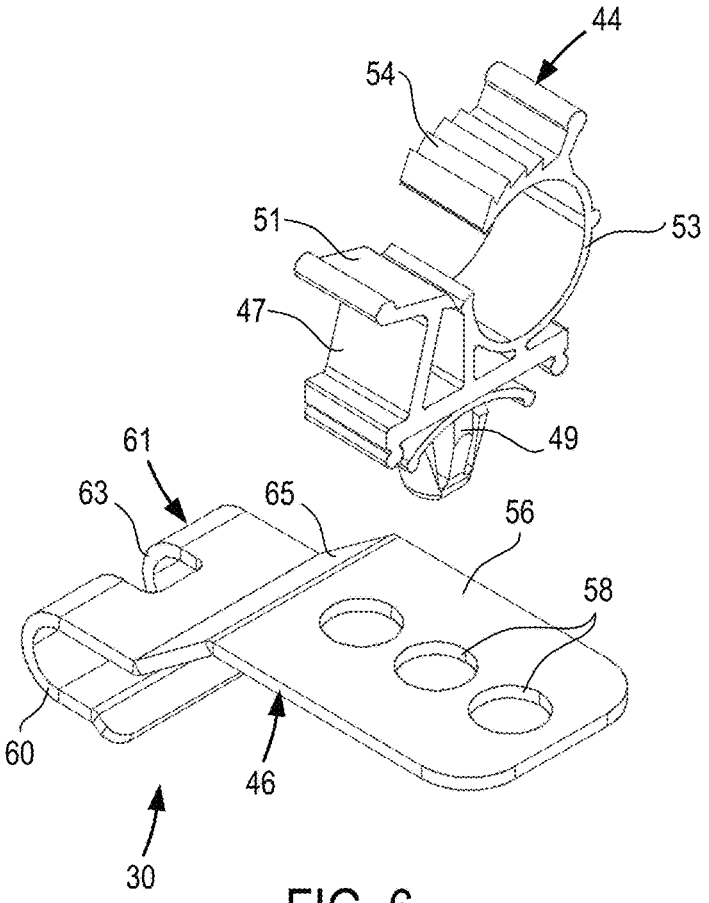
FIG. 6 is an enlarged detailed view of the power cord retainer of FIG. 4, the power cord retainer including a bracket and a cable clip shown in a preassembled state.
Figure 7:
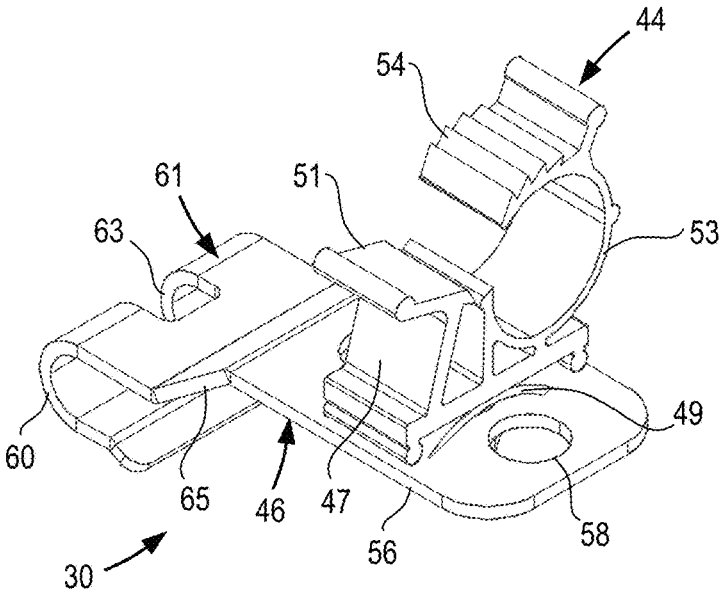
FIG. 7 is an enlarged detailed view of the power cord retainer of FIG. 4, the power cord retainer including a bracket and a cable clip shown in an assembled state.

As shown in FIGS. 6 and 7, the cable clip 44 generally includes a clip portion 47 configured to engage the cable 42 beyond the plug 40, and a mounting portion 49 located at the base of the clip portion configured to engage the bracket. In some embodiments, the cable clip is formed of an injection molded plastic, but one will appreciate that various materials may be used. For example, in some embodiments, the cable clip is formed of nylon.

In some embodiments, the clip portion 47 includes a releasable latch 51 and a clamp arm 53 configured for encircling the cable and releasably engaging the latch. The clamp arm may include a plurality of ratchet teeth 54 for adjustably engaging the releasable latch. One will appreciate that the clip portion may have other configurations to suitably engage the cable of the power cord.

The bracket 46 generally includes an elongated section 56, a plurality of mounts 58 extending along a length of the elongated section for adjustably receiving the mounting portion of the cable clip, and a hook section 60 at one end of the elongated portion configured for partially encircling the equipment module handle.

The hook section allows the bracket to be freely hung on the handle 39 of the equipment module in a first position during installation as shown in FIG. 1, and allows the bracket to extend substantially parallel to the power cord 32 while in a second position retaining the plug 40 in receptacle 37 of the equipment module 33 as shown in FIG. 2. In this position, the power cord retainer 30 holds the plug 40 in the power receptacle 37 by virtue of holding the power cord relative to the chassis when the clip portion 47 engages the power cord cable 42 and the hook section 60 partially encircles the equipment module handle 39.

In some embodiments, the mounts are a series of apertures 58 that extend along a length of the elongated section 56 of the bracket 46. One will appreciate that two, three, four, five or more apertures may be used depending upon the desired adjustability. For example, FIG. 2 shows a bracket having five apertures, while FIG. 6 shows a bracket having three apertures. The spaced apertures provide multiple distance choices thereby allowing the bracket to be used with various power cords with different overmolds or plugs.

One will also appreciate that the mounts may take various forms. For example, the mounts may be round apertures as shown in FIGS. 2 and 6, or the mounts may be rectangular or square, provided that their shape corresponds to that of the corresponding cable clip. One will appreciate that other suitable means may be utilized to adjustably secure the cable clip along length of the elongated section.

In some embodiments, the hook section 60 includes a U-shaped flange that is dimensioned to encircle a portion of the equipment module handle. Such a U-shaped configuration is particularly well suited for handles that have circular cross-sections, but may also be utilized with handles having other configurations such as a substantially rectangular or square cross-section. One will appreciate that the hook section may have other shapes and geometries. For example, the hook section may have a more rectilinear channel shape, a V-shape, or other suitable shape that allows the hook section to readily catch a handle of an equipment module.

In some embodiments, the hook section may include a reduced cross-sectional area portion 61 where the hook section contacts the equipment handle. For example, as shown in FIG. 6, the hook section may include a cut 63 that reduces the cross-sectional area of the bracket contacting the equipment handle. Such configuration reduces conductive heat transfer from the equipment module handle to the bracket, and thus minimizes conductive heat exchange between the equipment module and the bracket as well as the power cord. Such configuration does not interfere with the cooling performance of the equipment module.

In some embodiments, the bracket includes an inclined section 65 interconnecting the elongated section 56 and the hook section 60 offsetting the elongated section from the hook section. Such configuration allows for a more compact design as it allows a significant portion of the power cord retainer to be in close proximity to the relatively narrow cable 42 of the power cord.

In some embodiments, the bracket 46 is formed of sheet metal thus providing a simple design that is inexpensive to mass produce by stamping and/or other suitable manufacturing processes. One will appreciate that the bracket may be formed of other suitable materials provided that the bracket has sufficient structural integrity to hold and maintain the distance between the hook section cable clip to prevent inadvertent unplugging of the power cord from the equipment module.

Figure 8:
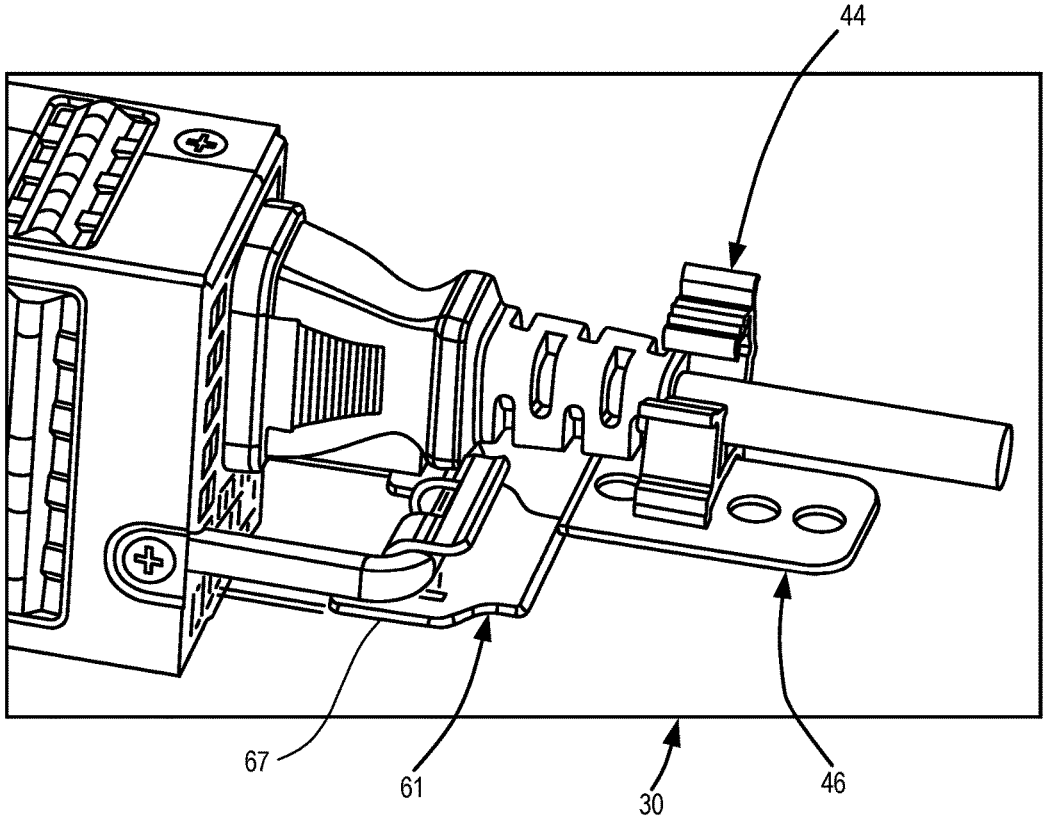
FIG. 8 is a perspective view of another exemplary power cord retainer in accordance with various aspects of the present invention, the power cord retainer shown mounted in the corresponding second position on a rack-mountable equipment module.
Figure 9:
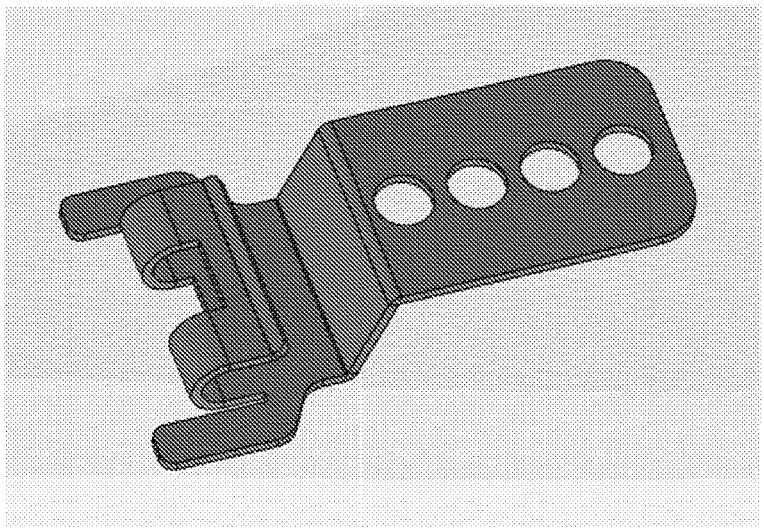
FIG. 9 is an enlarged detailed view of the bracket of the power cord retainer of FIG. 8.

In some embodiments, the bracket 46 is formed with one or more anti-rotation arms 67 adjacent the hook section. For example, as shown in FIG. 9, two anti-rotation arms extend beyond the U-shaped hook of the bracket so that the arms abut against the underside of handle 39 to prevent downward rotation of the bracket relative to the handle as shown in FIG. 8. One will appreciate that one or more arms may be provided to accomplish such prevention of downward rotation.

Advantageously, the power cord retainer 30 of the present invention is a tool-less assembly. The configuration of the hook section 60 allows the bracket to be simply hung on the equipment module handle 39 and swung into a position in which the cable clip 44 can engage the cable. And the configuration of the cable clip 44 allows a user to manually encircle and latch the cable clip around the cable.

In accordance with various aspects of the present invention, the power cord retainer prevents a power cord to be pulled out from an equipment module without changing the design of the equipment module or impacting cooling performance of the equipment module. The power cord retainer may be used with various equipment modules including, but not limited to data storage systems, servers, network routers, network switches, power supply units, and etc., without the need to modify the equipment modules with holes or other structures adapted to receive conventional wire or plastic retainers.

It will be understood that, although the terms "first," "second," etc. may be used herein to describe various elements, these elements should not be limited by these terms. These terms are only used to distinguish one element from another. For example, a first position could be termed a second position, and, similarly, a second position could be termed a first position, without changing the meaning of the description, so long as all occurrences of the "first position" are renamed consistently and all occurrences of the "second position" are renamed consistently. The first position and the second position are both positions, but they are not the same position.

The terminology used herein is for the purpose of describing particular embodiments only and is not intended to be limiting of the claims. As used in the description of the embodiments and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The foregoing description, for purpose of explanation, has been described with reference to specific embodiments. However, the illustrative discussions above are not intended to be exhaustive or to limit the claims to the precise forms disclosed. Many modifications and variations are possible in view of the above teachings. The embodiments were chosen and described in order to best explain principles of operation and practical applications, to thereby enable others skilled in the art.

What is claimed is:

1. A power cord retainer for an equipment module, the equipment module including a chassis, a power receptacle mounted on the chassis, a handle extending from the chassis adjacent the receptacle, and a power cord having a plug removably received by the power receptacle and a cable extending from the plug, the power cord retainer comprising:

a cable clip including a clip portion configured to engage the cable beyond the plug, the cable clip further including a mounting portion extending from the clip portion, the clip portion including a releasable latch and a clamp arm configured for encircling the cable and releasably engaging the latch; and a bracket including an elongated section, a plurality of mounts extending along a length of the elongated section for adjustably receiving the mounting portion of the cable clip, and a hook section at one end of the elongated section configured for partially encircling the equipment module handle;

wherein the power cord retainer is configured to secure the power cord plug in the equipment module power receptacle when the clip portion engages the power cord cable and the hook section partially encircles the equipment module handle.

2. The power cord retainer according to claim 1, wherein the clip portion is plastic.

3. The power cord retainer according to claim 1, wherein the clamp arm includes a plurality of ratchet teeth for adjustably engaging the releasable latch.

4. The power cord retainer according to claim 1, wherein the bracket is formed of sheet metal.

5. The power cord retainer according to claim 1, wherein the plurality of mounts is a plurality of apertures extending along the length of the elongated section of the bracket.

6. The power cord retainer according to claim 1, wherein the hook section includes a U-shaped flange dimensioned to receive a portion of the equipment module handle.

7. The power cord retainer according to claim 1, wherein the hook section includes a reduced cross-sectional area portion that is configured to contact the equipment module handle, whereby the reduced cross-sectional area portion is configured to reduce conductive heat transfer from the equipment module handle to the bracket.

8. The power cord retainer according to claim 1, wherein the hook section includes a cut configured to reduce the cross-sectional area of the bracket contacting the equipment module handle to reduce conductive heat transfer from the equipment module handle to the bracket.

9. The power cord retainer according to claim 1, wherein the bracket includes an inclined section interconnecting the elongated section and the hook section offsetting the elongated section from the hook section.

10. The power cord retainer according to claim 1, wherein the bracket includes an anti-rotation arm extending beyond the hook section configured to abut against an underside of the equipment module handle and prevent downward rotation of the bracket relative to the equipment module handle.

11. A power cord retainer apparatus comprising:

an equipment module, the equipment module including a chassis, a power receptacle mounted on the chassis, and a handle extending from the chassis adjacent the receptacle;

a power cord having a plug removably received by the power receptacle and a cable extending from the plug; and a power cord retainer comprising:

a cable clip including a clip portion releasably engaging the cable beyond the plug, the cable clip further including a mounting portion extending from the clip portion, the clip portion including a releasable latch and a clamp arm configured for encircling the cable and releasably engaging the latch; and a bracket including an elongated section, a plurality of mounts extending along a length of the elongated section for adjustably receiving the mounting portion of the cable clip, and a hook section at one end of the elongated section partially encircling the equipment module handle;

wherein the power cord retainer secures the power cord plug in the equipment module power receptacle when the clip portion engages the power cord cable and the hook section partially encircles the equipment module handle.

12. The power cord retainer apparatus according to claim 11, wherein the clip portion is plastic.

13. The power cord retainer apparatus according to claim 11, wherein the clamp arm includes a plurality of ratchet teeth for adjustably engaging the releasable latch.

14. The power cord retainer apparatus according to claim 11, wherein the bracket is formed of sheet metal.

15. The power cord retainer apparatus according to claim 11, wherein the plurality of mounts is a plurality of apertures extending along the length of the elongated section of the bracket.

16. The power cord retainer apparatus according to claim 11, wherein the hook section includes a U-shaped flange dimensioned to receive a portion of the equipment module handle.

17. The power cord retainer apparatus according to claim 11, wherein the hook section includes a reduced cross-sectional area portion that is configured to contact the A-equipment module handle, whereby the reduced cross-sectional area portion is configured to reduce conductive heat transfer from the equipment module handle to the bracket.

18. The power cord retainer apparatus according to claim 11, wherein the hook section includes a cut configured to reduce the cross-sectional area of the bracket contacting the equipment module handle to reduce conductive heat transfer from the equipment module handle to the bracket.

19. The power cord retainer apparatus according to claim 11, wherein the bracket includes an inclined section interconnecting the elongated section and the hook section offsetting the elongated section from the hook section.

20. The power cord retainer apparatus according to claim 11, wherein the bracket includes an anti-rotation arm extending beyond the hook section configured to abut against an underside of the equipment module handle and prevent downward rotation of the bracket relative to the equipment module handle.

* * * * *